United States Patent [19]

Johnson et al.

[11] 3,968,884

[45] July 13, 1976

[54] STORAGE MEANS FOR JIB FOR TELESCOPIC BOOM OF MOBILE CRANE

[76] Inventors: James N. Johnson; James C. Mayo, Sr., both of Cedar Rapids, Iowa;

[73] Assignee: Harnischfeger Corporation, Milwaukee, Wis.

[22] Filed: Dec. 20, 1974

[21] Appl. No.: 534,746

[52] U.S. Cl. ..... 212/55; 212/144; 212/59 R; 52/114; 248/242; 248/278

[51] Int. Cl.[2] ..... B66C 23/06

[58] Field of Search ..... 212/54–55, 212/28, 144, 58 R, 59 R; 248/278, 242, 240, 279; 52/114, 116; 224/42.08, 42.28

[56] References Cited

UNITED STATES PATENTS

| | | | |
|---|---|---|---|
| 710,780 | 10/1902 | Hutchen | 248/242 |
| 946,337 | 1/1910 | Clear | 248/242 |
| 1,891,250 | 12/1932 | Thompson | 248/278 |
| 2,895,628 | 7/1959 | Gebhart | 248/279 X |
| 3,158,267 | 11/1964 | Carbert et al. | 212/55 |
| 3,305,204 | 2/1967 | Babin | 248/278 |
| 3,628,675 | 12/1971 | Balogh | 212/55 X |
| 3,698,569 | 10/1972 | Lamer | 212/144 |
| 3,785,505 | 1/1974 | Keller | 212/144 |
| 3,831,771 | 8/1974 | Wiencek | 212/55 |

FOREIGN PATENTS OR APPLICATIONS

| | | | |
|---|---|---|---|
| 313,292 | 3/1956 | Sweden | 248/242 |

*Primary Examiner*—L. J. Paperner
*Assistant Examiner*—R. B. Johnson
*Attorney, Agent, or Firm*—James E. Nilles

[57] ABSTRACT

A mobile crane has a multisection telescopic boom and an optionally useable lattice jib storable alongside the boom with the base end of the jib adjacent the point end of the boom. Improved jib storage support means are provided to facilitate storing and installing the jib. Thus, one side of the boom base section is provided with a pair of longitudinally spaced apart jib storage support assemblies. Each support assembly is pivotally mounted so that it can be swung between a jib-supporting position and a stored position. Each support assembly includes a laterally extending member which is tiltable between a horizonal and a downward position so that the jib can be easily swung thereonto for storage and then subsequently locked into horizontal position, whereupon locking brackets secure the jib on the support assembly. The point end of the boom fly section and the base end of the jib are provided with cooperating disconnectable hinge members for attacing the jib to the boom so that the jib can be swung horizontally between stored and installed positions. The point end of the boom fly section and the base end of the jib are also provided with connection means for securing the jib to the boom.

8 Claims, 22 Drawing Figures

STORAGE MEANS FOR JIB FOR TELESCOPIC BOOM OF MOBILE CRANE

BACKGROUND OF THE INVENTION

1. Field of Use

This invention relates generally to storage means for an optionally useable jib for a multisection telescopic boom of a mobile crane.

2. Description of the Prior Art

Some mobile cranes have a multisection telescopic boom and a jib attachable or swingable into a position at the end of the boom to extend its working length. In some cases the jib is permanently connected to the boom and is swingable into and out of working position. In other cases the jib is completely detachable and is stored alongside the telescoped boom during road transport but can be readied for use by pivotally connecting the base end of the jib to the point end of the boom, whereupon the jib is swung into alignment with the boom secured in place. U.S. Pat. Nos. 3,366,250; 3,698,569; 3,785,505 and 3,830,376 exemplify boom and jib arrangements of the aforesaid types. In some of the prior art arrangements where jib storage means are required, it is difficult to move the jib onto or off of the jib storage means, especially where a very large jib is involved, because of great frictional forces involved.

SUMMARY OF THE INVENTION

Generally considered, a mobile crane in accordance with the present invention comprises a multisection telescopic boom extendable to about 105 feet, including a base section, a plurality of intermediate sections, and a fly section, and an optionally useable lattice jib about 30 feet long, including jib base section and a detachable jib point section, storable alongside the boom with the base end of the jib adjacent the point end of the boom. Additional jib sections about 20 feet long can be connected between the jib base section and the jib point section, such additional jib sections being mounted elsewhere on the mobile crane or transported separately.

Improved jib storage support means are provided to facilitate storing and installing the jib. One side of the boom base section is provided with a pair of longitudinally spaced apart jib storage support assemblies. Each support assembly is pivotally mounted so that it can be swung between a jib-supporting position and a stored position. Each support assembly includes a laterally extending member which is tiltable between a horizontal and a downward position so that the jib can be easily swung off of the support assembly and also thereunto for storage. When the jib is in stored position, the tiltable member is locked into horizontal position, whereupon locking brackets are connected to secure the jib on the support assembly.

Hinge means are provided for connecting the jib so that it can be swung horizontally between stored and installed positions. The point end of the boom fly section and the base end of the jib are provided with cooperating disconnectable hinge members for attaching the jib to the boom so that the jib can be swung horizontally between stored and installed positions. The hinge means enable the jib to be pivotally connected to the boom while still in stored position and then swung between the stored position and a position in alignment with the boom. The hinge means are disconnectable during storage so that the boom can be used independently of the jib. The hinge means are also disconnectable after the jib has been secured to the boom so that the jib can be placed in a downwardly tilted position with respect to the boom either for the purpose of connecting additional jis sections or for the purpose of allowing the jib to be offset from the boom axis to suit particular job conditions. Connection means are provided for securing the jib to the boom in either axially aligned position or in downwardly tilted position.

A mobile crane having jib storage means in accordance with the present invention offers many advantages over prior art arrangements. For example, the jib storage means enable a single operator to swing the jib off of or onto the storage means by virtually eliminating frictional forces encountered in prior art arrangements. Furthermore, the jib storage means provide locking means for securing the jib in place when stored. Also, the jib storage assemblies can be swung and locked out of the way when not in use. Other objects and advantages of the invention will hereinafter appear.

DRAWINGS

DESCRIPTION OF A PREFERRED EMBODIMENT

General Arrangement

Figure 1:
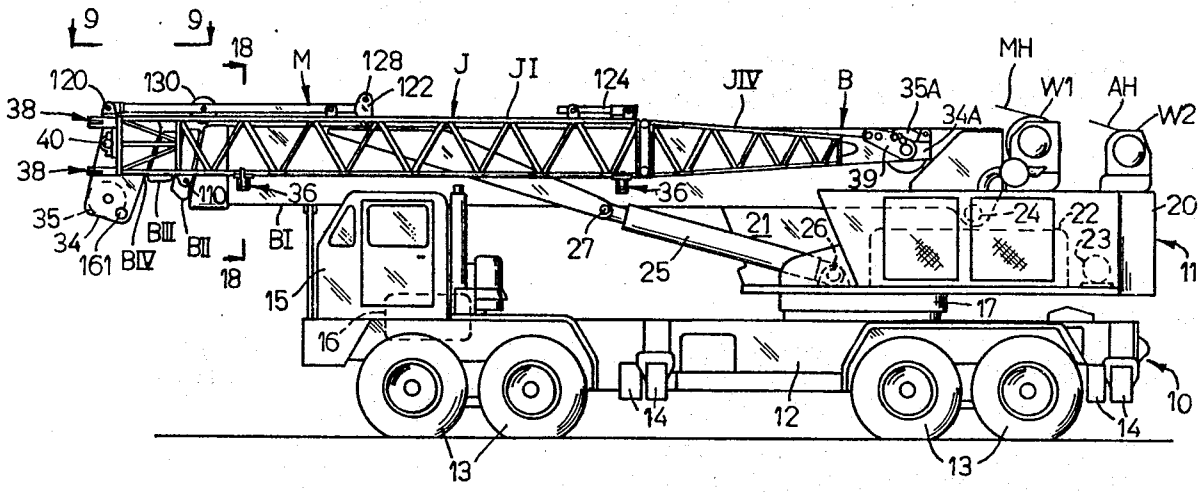
FIG. 1 is a side elevational view of a mobile crane having a multisectioned telescopic main boom and having a jib disposed alongside the main boom in stored position according to the invention.

Referring to FIGS. 1 through 8, there is shown apparatus such as a mobile crane in accordance with the invention and which comprises a lower unit 10 in the form of a vehicle such as a truck and an upper unit 11 which is mounted for horizontal rotation in either direction on the lower unit by means of a conventional turret 17. Truck 10 comprises a chassis 12 on which are mounted ground wheels 13, extendable outriggers 14, a driver's cab 15 and an internal combustion engine 16 beneath the cab for driving the ground wheels. Upper unit 11 comprises a supporting framework 20 on which are mounted a telescopic boom B, main and auxiliary winches W1 and W2, respectively, on which load hoist lines MH and AH, respectively, are wrapped, a crane operator's cab 21, and an internal combustion engine 22 for driving a hydraulic pump 23 which supplies operating fluid for the winches W1 and W2 and hydraulic cylinders hereinafter described.

Boom B, which is shown in a generally horizontal telescoped and stored position lengthwise of truck 10, comprises four hollow boom sections, namely: a base section BI, an inner midsection BII, an outer midsection BIII, and a fly section BIV. Boom base section BI is pivotally connected to framework 20 of upper unit 11 by pin means 24. Extendable and retractable hydraulic boom hoist cylinders 25 are provided to raise and lower boom B and each is pivotally connected to and between framework 20 and boom base section BI by pin means 26 and 27, respectively. Fly section BIV is provided with a working head 34 at the boom point on which a sheave 35 for load hoist line MH is rotatably mounted. In an actual embodiment, for example, boom B is fully extendable to about 105 feet.

Figure 8:
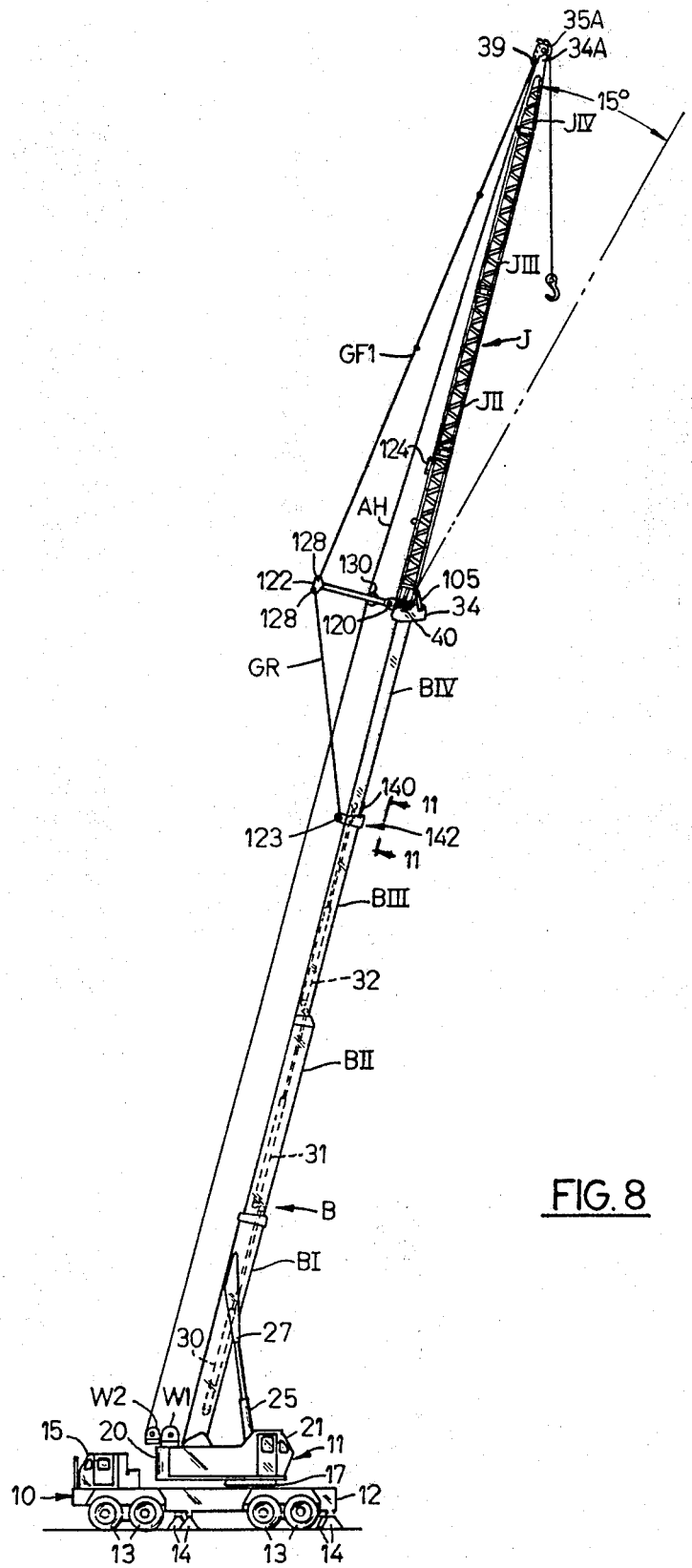
FIG. 8 is a side elevational view of the mobile crane with its main boom fully extended and fully raised and with a multisectioned jib disposed in operating position.

As FIG. 8 shows, extendable and retractable hydraulic boom extension cylinders 30, 31 and 32 are located within boom B and are connected to boom sections BII, BIII and BIV, respectively, to effect axial extension and retraction of the latter. Control means (not shown) are understood to be provided to operate the cylinders 30, 31 and 32 either individually or in unison, depending upon the crane operator's choice.

Figure 2:
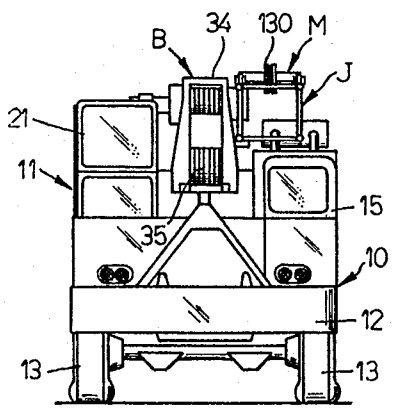
FIG. 2 is a front end view of the mobile crane shown in FIG. 1.

Generally considered, the mobile crane has an optionally useable lattice-type jib J storable alongside boom B, with the base end of the jib adjacent the point end of the boom. Jib J is shown in FIGS. 1 through 5 as comprising two hollow lattice-type jib sections, namely a jib base or foot section JI about 20 feet long and a jib fly or point section JIV about 10 feet long. When jib J is stored, as shown in FIGS. 1 and 2, it is reversely disposed with respect to boom B, i.e., its foot end is adjacent, near or toward the point of boom B and its point end is adjacent, near or toward the base of foot end of boom B. Jib fly section JIV is provided with a working head 34A at the jib point on which a sheave 35B for load hoist line AH is rotatably mounted. Jib J is adapted, for example, to extend the length of boom B by about 30 feet or more, depending on the number of jib sections used. In FIG. 8, jib J comprises four sections, JI, JII, JIII and JIV.

Figure 3:
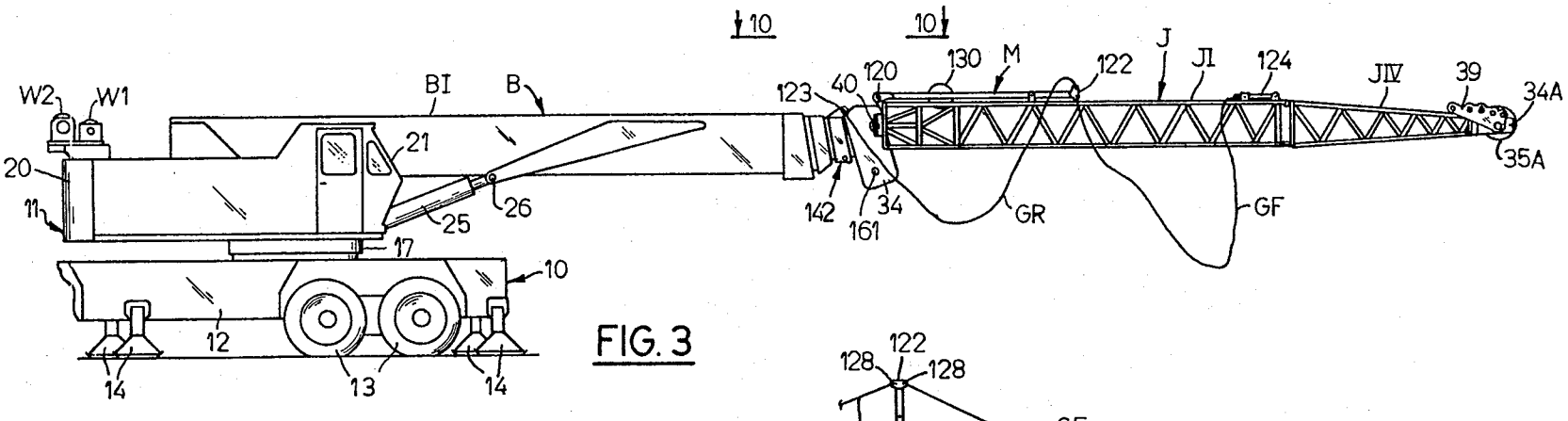
FIG. 3 is a side elevational view of a portion of the mobile crane shown in FIG. 1 but showing the crane upper section reversed and showing the jib swung into alignment with the main boom.
Figure 4:
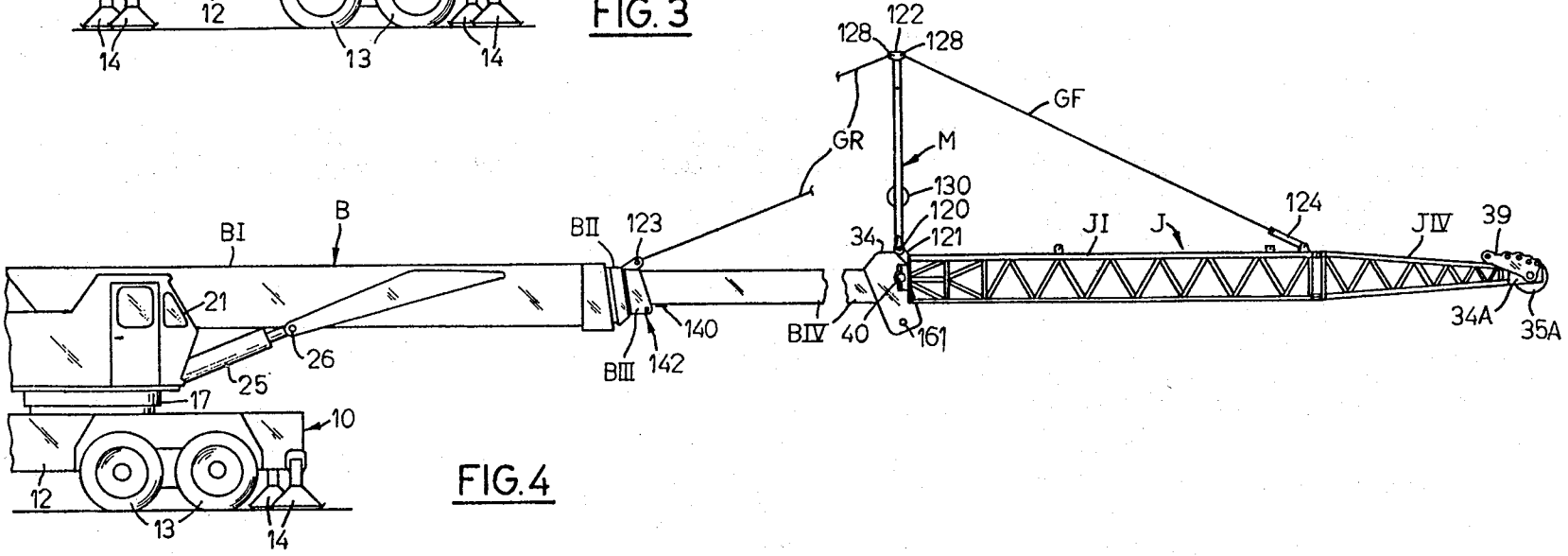
FIG. 4 is a view similar to FIG. 3 but showing the fly section of the main boom partially extended and the jib mast erected.

The point end of jib point section JIV is also provided, as FIGS. 1, 3 and 4 show, with a fan-shaped cable support member 39 in the form of a pair of plates which are rigidly secured to the jib section and is provided with a plurality of holes to which the forward guy lines may be anchored as hereinafter explained. The jib point section JIV is detachably secured to jib base section JI by suitable removable pins.

Figure 15:
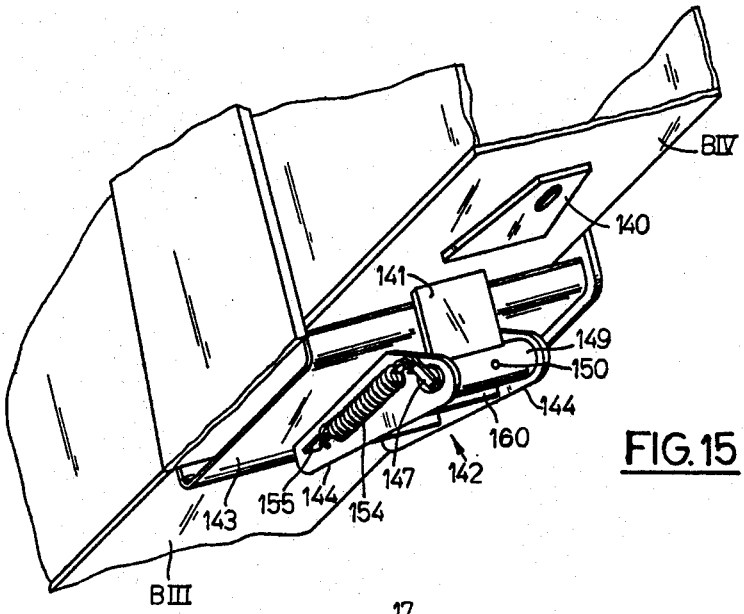
FIG. 15 is an isometric view of the lower side of the point end of the boom and shows the fly safety latch.
Figure 16:
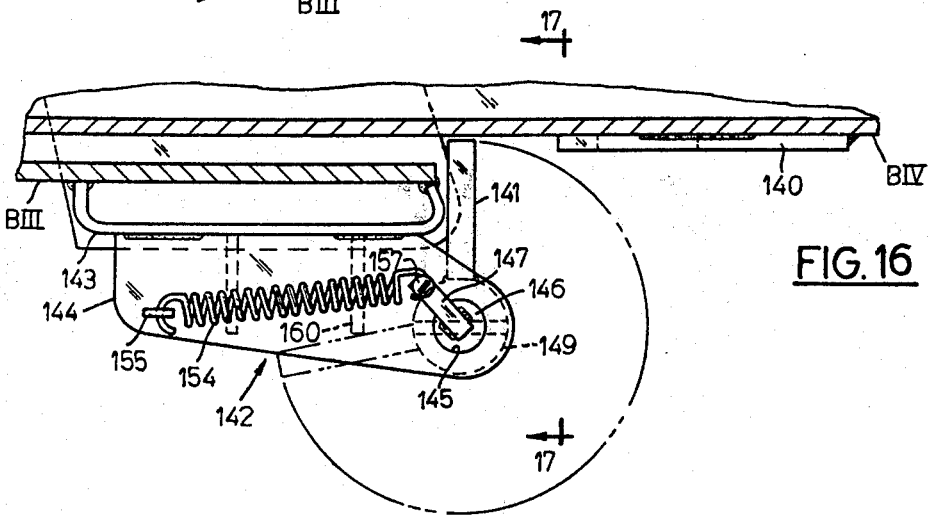
FIG. 16 is an enlarged cross sectional view of the fly safety latch shown in FIG. 15.
Figure 17:
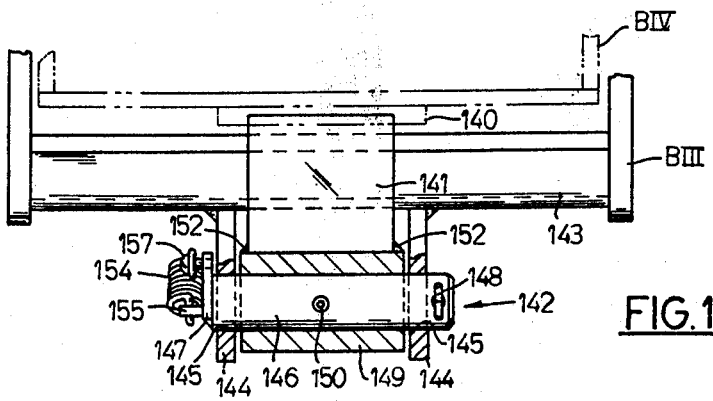
FIG. 17 is a view of the fly safety latch taken on line 17—17 of FIG. 16 with certain parts in cross section.

One side of the boom base section BI is provided with a pair of longitudinally spaced apart jib storage support assemblies 36 to facilitate storing and installing the jib J. As FIGS. 9 through 14 show, the point end of the boom fly section BIV and the base end of the jib J are provided with cooperating disconnectable hinge members 37 and 38, respectively, for attaching the jib J to the boom B so that the jib can be swung horizontally between stored and installed positions, as comparison of FIGS. 1 and 4 shows. The point end of the boom fly section BIV and the base end of the jib J are provided with connection means, including a cylindrical rod 40 on the boom fly section head 34 and cooperating journal bearings 41 on the jib, for securing the jib to the boom in either axial aligned position, shown in FIG. 3, or in downwardly tilted position, shown in phantom in FIG. 8, and adjustable strut means or members, shown in FIGS. 7, 8, 12 and 13, are detachably connected between the boom and jib to limit the extent to which the jib can be tilted. The jib J is provided with a self-storing and self-erecting jib mast M which is pivotally mounted on the upper side of the jib which cooperates with forward and rearward guy lines GF and GR, respectively, to support the jib during set-up and operation of the crane. Releasable locking means 43, best seen in FIGS. 15, 16 and 17, are provided on the boom fly section BIV and the next adjacent intermediate boom section BIII to prevent the extended boom fly section from accidentally telescoping under the weight of the jib J in the event of a hydraulic system failure.

The Jib Storage Means

Figure 18:
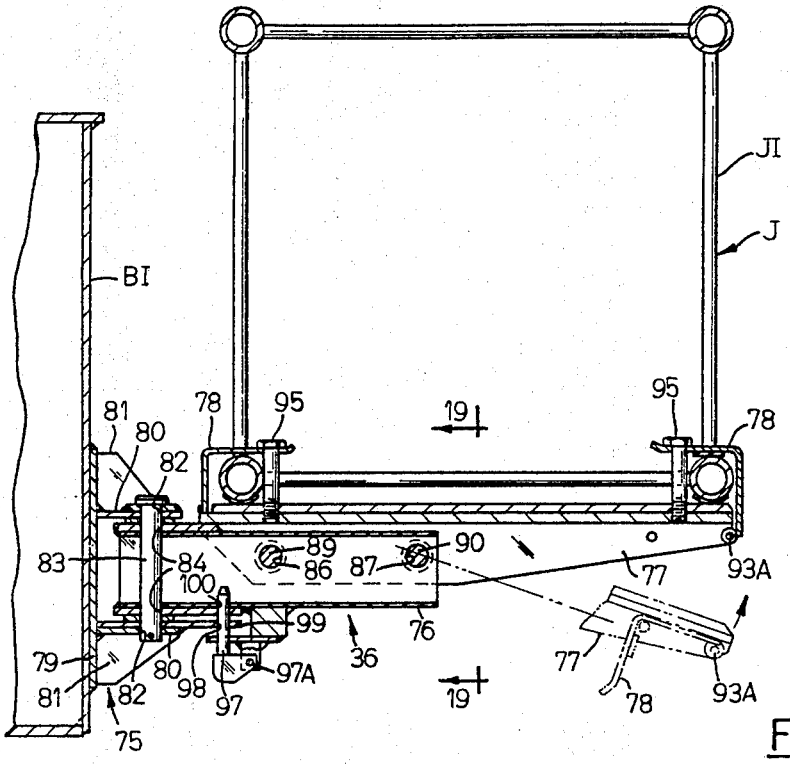
FIG. 18 is an enlarged cross sectional view of the front jib storage support assembly taken on line 18—18 of FIG. 1.
Figure 20:
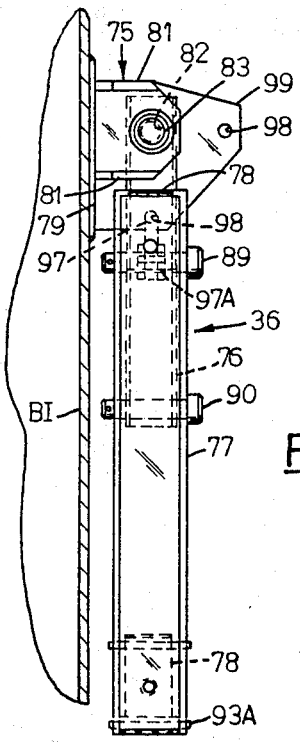
FIG. 20 is a top plan view of the jib storage support assembly shown in FIG. 18 and showing it in an alternate or stored position.
Figure 19:
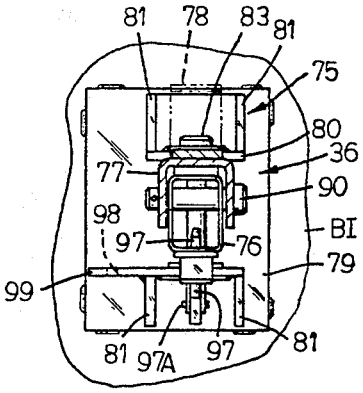
FIG. 19 is an enlarged detailed view of a portion of the jib storage support assembly taken on line 19—19 of FIG. 18.
Figure 21:
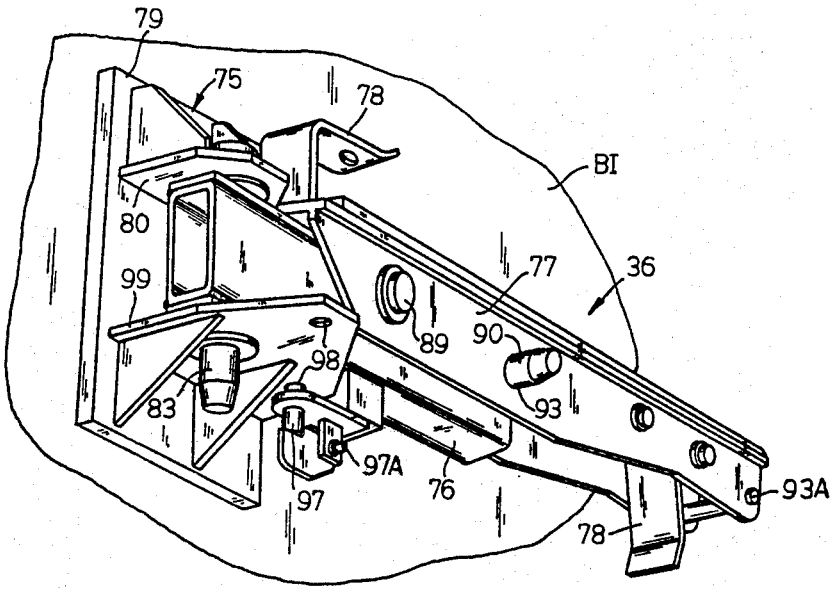
FIG. 21 is a perspective view showing the jib storage support assembly in stored position.
Figure 22:
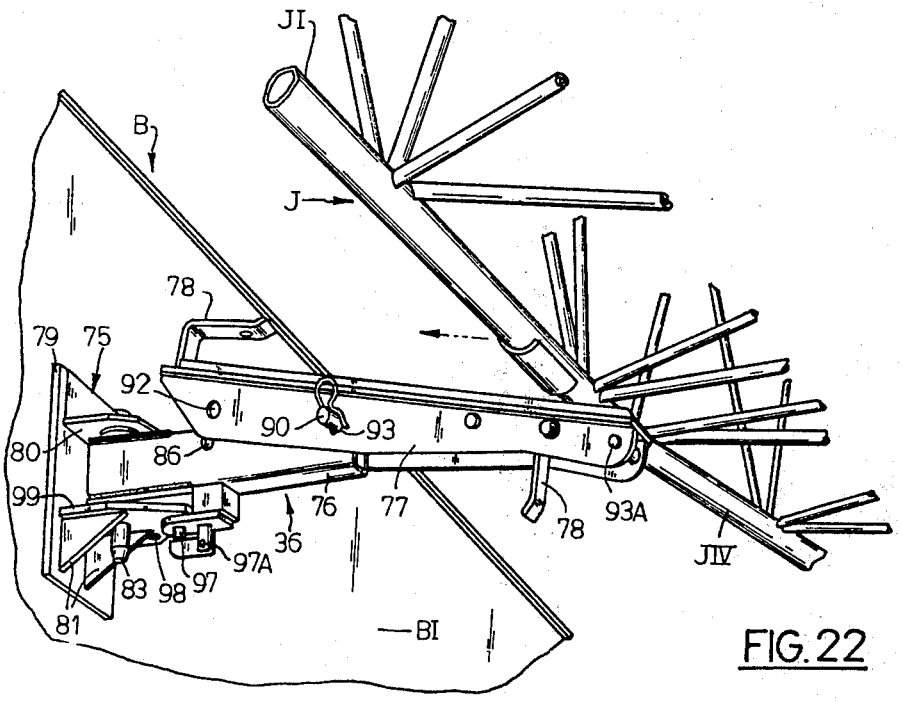
FIG. 22 is a perspective view showing the jib being moved onto the jib storage support assembly.

Improved jib storage support means are provided to facilitate storing and installing the jib J. As FIG. 1 shows, one side of the boom base section BI is provided with a pair of longitudinally spaced apart front and rear identical jib storage support assemblies 36 to facilitate storing and installing the jib. As FIGS. 18 through 22 make clear, each support assembly 36 comprises a mounting bracket 75 and a hollow rigid support member or beam 76 which is pivotally mounted thereon so that it can be swung between a supporting position (FIG. 18) and a stored position (FIG. 20). Each support assembly 36 further includes a laterally extending member 77 which is pivotally mounted on support member 76 and tiltable between a horizontal position (shown in solid lines in FIG. 18) and a downward position (shown in phantom lines in FIG. 18) so that the jib J can be easily swung thereonto for storage and then subsequently locked into horizontal position by locking clamps 78 to secure the jib on the support assembly. Each storage assembly 36 comprises a mounting bracket 75 which is rigidly secured to the side of boom base section BI. The bracket 75 comprises a rear plate 79, two laterally extending vertically spaced apart upper and lower hinge plates 80 which are rigidly secured, as by welding, to the rear plate, and suitable gussets 81 which are rigidly secured between the rear plate and the hinge plates. The hinge plates 80 are each provided with a hole 82 for accommodating a vertically extending hinge pin 83. The hollow rectangular support or box beam 76 has its inner end disposed between the upper and lower hinge plates 80 and is pivotally secured thereto by means of the hinge pin 83 which extends through holes 84 in the beam 76. The beam 76 is movable between an extended position wherein it projects outwardly from the side of the boom as shown in FIG. 22, and a stored position wherein it is disposed alongside the boom, as shown in FIG. 20. The beam is provided with a pair of longitudinally spaced apart pin holes 86 and 87 therethrough for accommodating a locking pin 89 and a pivot pin 90, respectively. U-shaped member 77 for directly supporting the jib J in stored position is pivotally connected to the box beam 76 by pin 90. The U-shaped member 77 is provided with a pair of holes 92 and 93 which register with the pair of holes 86 and 87, respectively, in the box beam 76. When the jib J is in stored position, as shown in FIG. 18, the U-beam 77 is parallel with the box beam 76 and both the pins 89 and 90 are in place. To facilitate the placement or removal of the jib on or from the support assemblies 36, only the pivot pin 90 is kept in place and this allows the U-beam 77 to move between the horizontal and the downwardly tilted positions shown in FIG. 18. To store, the jib J is swung across the downwardly tilted U-beam 77 which rides up the inclined plane partially braking the rotational momentum. The U-beam 77 then assumes the horizontal position and the locking pin 89 may then be secured in place. Conversely, to unstore, the locking pin 89 is removed and beam 77 tilts downwardly to reduce friction as the jib J swings away from the side of the boom B. The U-beam 77 is provided with a pair of generally L-shaped clamps 78, one of which is pivotally connected at one end thereof by a pin 93A and which is movable to a position clear of the jib (as shown in FIGS. 21 and 22) when the jib is being stored or unstored. After the jib J has been properly positioned for storage on the support means 36, the clamp 78 is swung to the locking position shown in FIG. 18 and secured in place by means of the locking bolt 95. The inner clamp 78 is also provided with a locking bolt 95. The box beam 76 is lockable in either its extended or stored position by means of a removable lock pin 97 which is extendable through a hole 98 in a plate 99 attached to plate 79 and a hole 100 in box beam 76. Pin 97 can be removed after a pin 97A is withdrawn.

The Hinge Means and Connection Means

Figure 14:
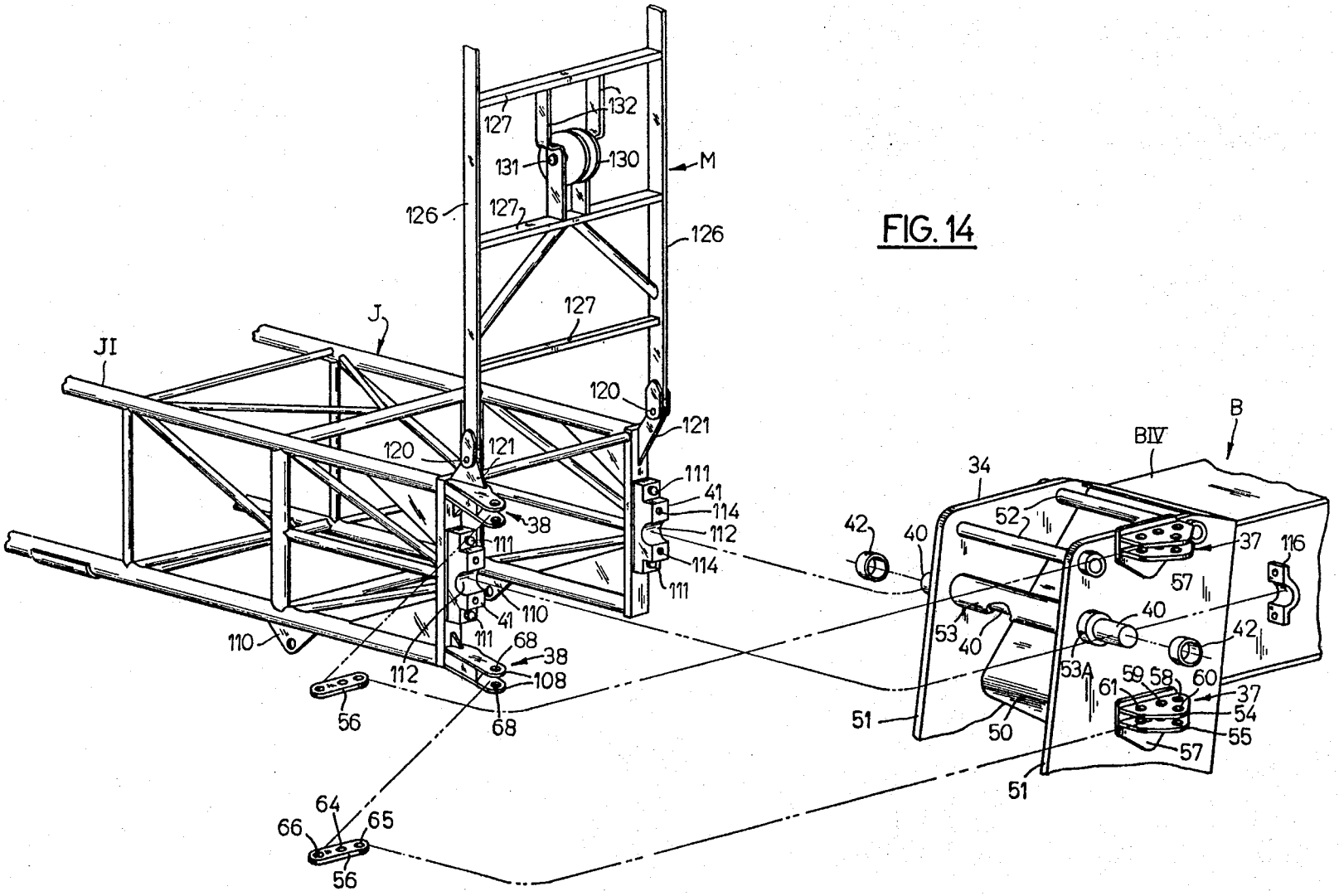
FIG. 14 is an exploded isometric view of the point end of the boom and the base end of the jib.

As FIG. 14 best shows, the working head 34 on boom section BIV comprises a rear plate 50 which is rigidly secured, as by welding, to the outermost forward end of the fly section and two laterally spaced apart side plates 51 which are rigidly secured, as by welding, to the rear plate 50. The two side plates 51 are further rigidified by a plurality of cross members 52 which are welded therebetween. The working head 34 supports the cylindrical rod 40 which extends through a tube 53 which is welded between the plates 51. The rod 40 extends outwardly for a short distance from the outer ends of tube 53 and is secured to the tube by a pin 53A. The outwardly extending ends of rod 40 serve as a means by which the jib J is connected to boom B as hereinafter explained.

Improved hinge means are provided for connecting the jib J so that it can be swung horizontally between stored and installed positions. The point end of the boom fly section BIV and the base end JI of the jib J are provided with cooperating disconnectable hinge assemblies 37 and 38, respectively, for attaching the jib to the boom so that the jib can be swung horizontally between stored and installed positions. The hinge assemblies 37 and 38 enable the jib J to be pivotally connected to the boom B, by hinge links 56, while still in stored position and then swung between the stored position and a position in alignment with the boom. The hinge assemblies 37 and 38 are disconnectable from each other by detachment of the links 56 during jib storage so that the boom B can be used independently of the jib J. The hinge assemblies 37 and 38 are also disconnectable after the jib J has been secured to the boom B so that the jib can be placed in a downwardly tilted position with respect to the boom, either for the purpose of connecting additional jib sections such as JII and JIII or for the purpose of allowing the jib axis to be offset from the boom axis to suit particular job conditions.

Figure 9:
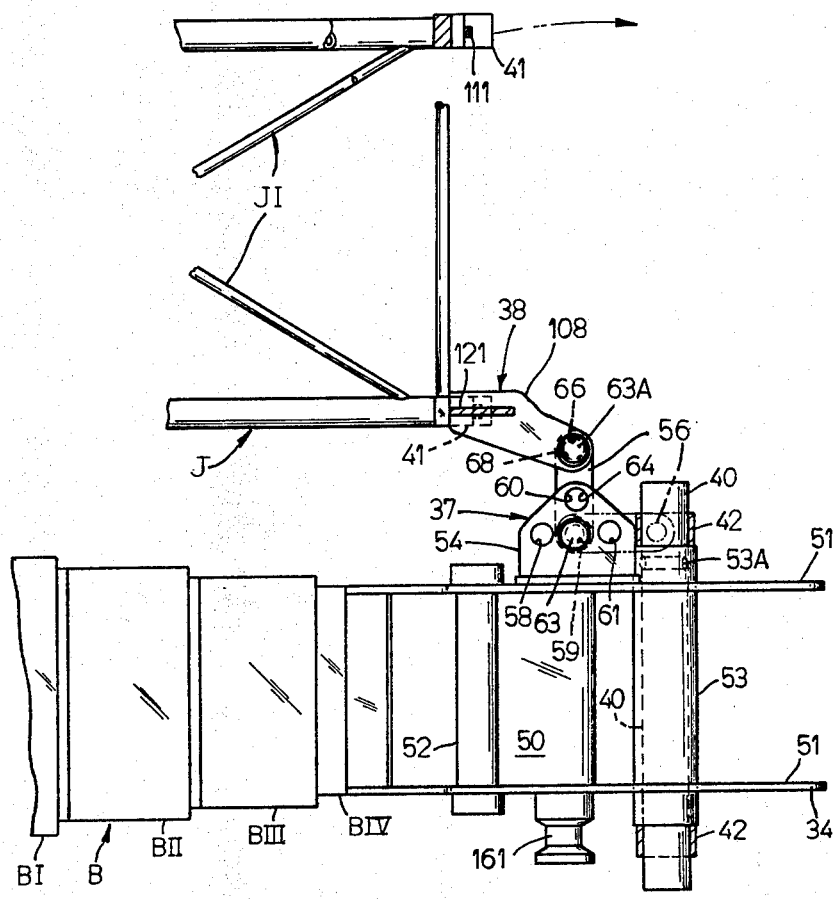
FIG. 9 is an enlarged top plan view of the point end of the boom and the base end of the jib taken on line 9—9 of FIG. 1.
Figure 10:
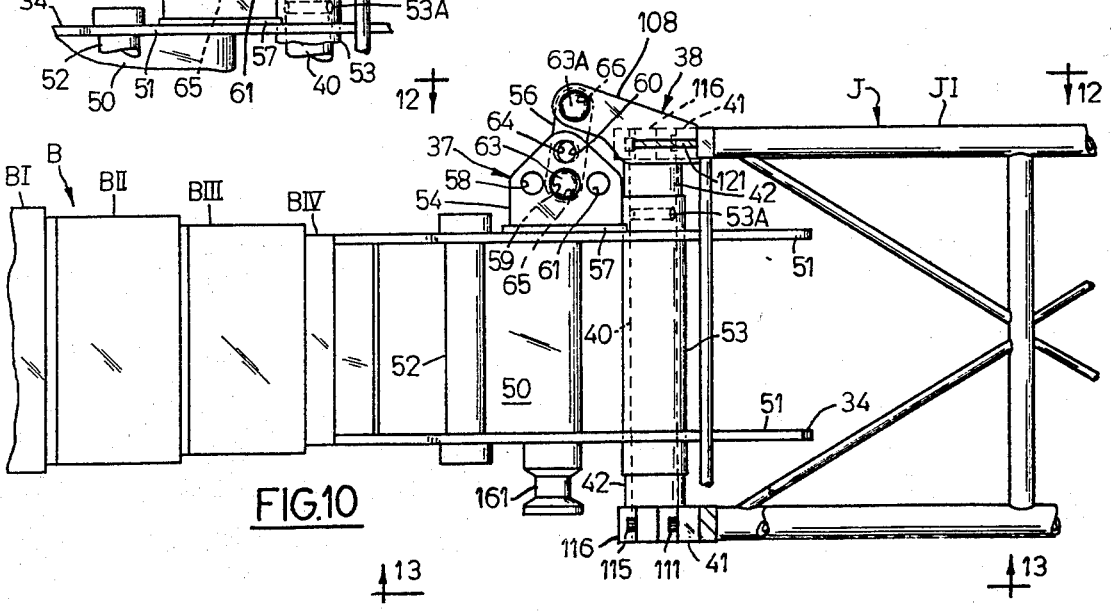
FIG. 10 is a top plan view of the point end of the boom and the base end of the jib taken on line 10—10 of FIG. 3.

As FIGS. 9 through 14 show, the outer side of one side plate 51 of working head 34 is provided with a pair of vertically spaced apart substantially identical hinge assemblies 37 for pivotally connecting the base end of jib J to head 34 at the point end of boom B. Each hinge assembly 37 comprises a back plate to 57 which is welded to its associated side plate 51 and two horizontally disposed vertically spaced aparat laterally extending upper and lower plates 54 and 55, respectively, which have a plurality of holes 58, 59, 60 and 61 therethrough, the holes in upper plate being in registry with the holes in the lower plate. Each hinge assembly 37 is adapted to accommodate a detachable hinge link 56 which can be disposed between the plates 54 and 55 and pivotally secured thereto by means of a central hinge pin 63 through the central hole 59 in the plates 54 and 55 and a hole 65 in the link. During road transport of the jib J the link 56 is secured in the forward position shown in phantom in FIG. 9 by means of a second hinge pin 63A in the front hole 61 in the plates 54 and 55 and the center hole 64 in link 56 and is not attached to the jib. As FIGS. 9 and 10 show, however, when the jib J is to be swung from its stored position to its installed position, the outermost end of the link 56 is connected to the associated hinge member on the base end of the jib. As the jib J is swung into position, it is capable of pivoting about hinge pin 63A, which is then disposed in hole 66 in link 56 and the holes 68 in the hinge assembly 38 on the jib J.

The base end of the jib base section JI is provided with a pair of vertically spaced apart hinge assemblies 38 which are welded thereto and cooperate with the hinge assemblies 37 on the working head 34 of the boom B. Each hinge assembly 38 comprises a pair of horizontally disposed vertically spaced apart rigid plates 108 having the aligned holes 68 therein and between which plates 108 and link 56 can be fitted.

Figure 13:
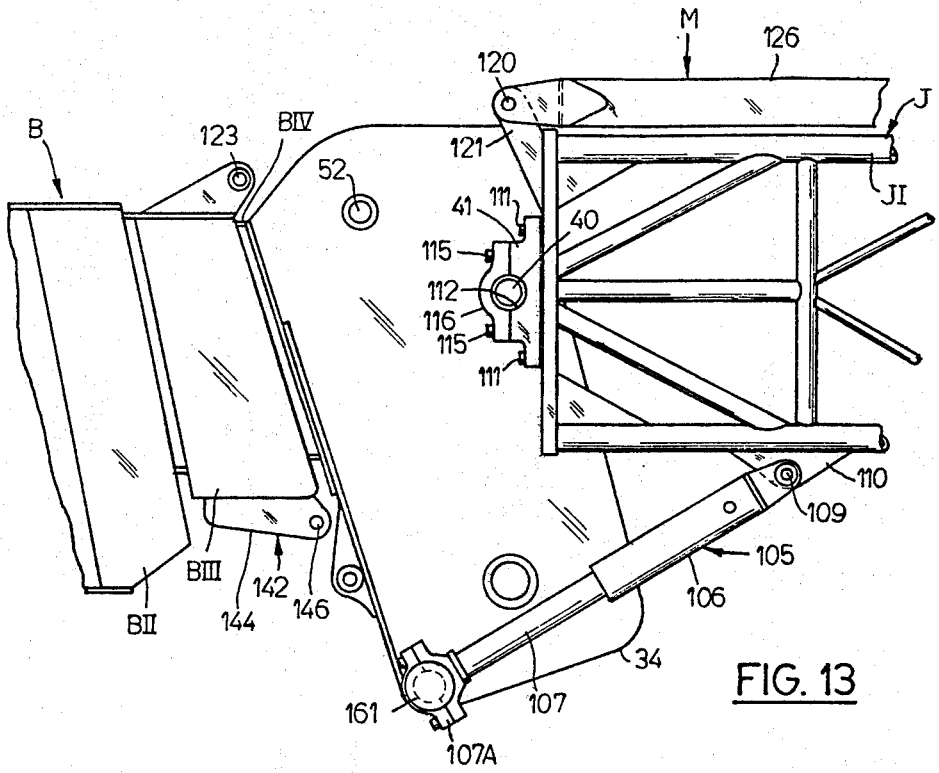
FIG. 13 is a view of the point end of the boom and the base end of the jib taken on line 13—13 of FIG. 10.

Improved connection means are provided for securing the jib J to the boom B in either axially aligned position (see FIGS. 3 through 8) or in downwardly tilted position (see FIG. 8 phantom showing). The point end of the boom fly section BIV and the base end of the jib J are provided with connection means, including the cylindrical rod 40 on the boom fly section and the cooperating journal bearings 41 on the jib, for enabling the jib to be secured to the boom in either axial aligned position or in downwardly tilted position, and adjustable detachable strut means, including a pair of laterally spaced apart struts 105, are detachably connected between the boom and jib to limit the extent to which the jib can be tilted for erection and to provide backstop means. The connection means for securing the jib J to the boom B also enable the jib to be self-positioned as it is swung into axial alignment with the boom. As heretofore explained, the base end of the jib base section JI is provided with shimmed journals 41 which are adapted for mating with and connection to the outwardly projecting ends of the cylindrical member 40. Each journal 41, which is secured to the jib J by bolts 111, comprises a semicircular groove 112 for engagement with an end of the pin or member 40. Each journal 41 is further provided with a pair of spaced apart threaded holes 114 for accommodating, as FIG. 13 shows, bolts 115, which secure a complementary journal cap 116 to the journal 41 into position thereon to encircle the end of member 40 and secure the jib to the boom. This arrangement permits the jib J to be pivotally movable with respect to the boom B for two purposes, namely: to enable the jib to be pivoted downwardly (by slacking off on the rear guy lines GR) and supported on the ground when the boom is horizontal so that additional jib sections can be attached or removed, and to allow the jib to be pivoted to the position shown in FIG. 8 when circumstances so require. Spacers 42 are provided to prevent lateral shifting of the jib J.

Figure 12:
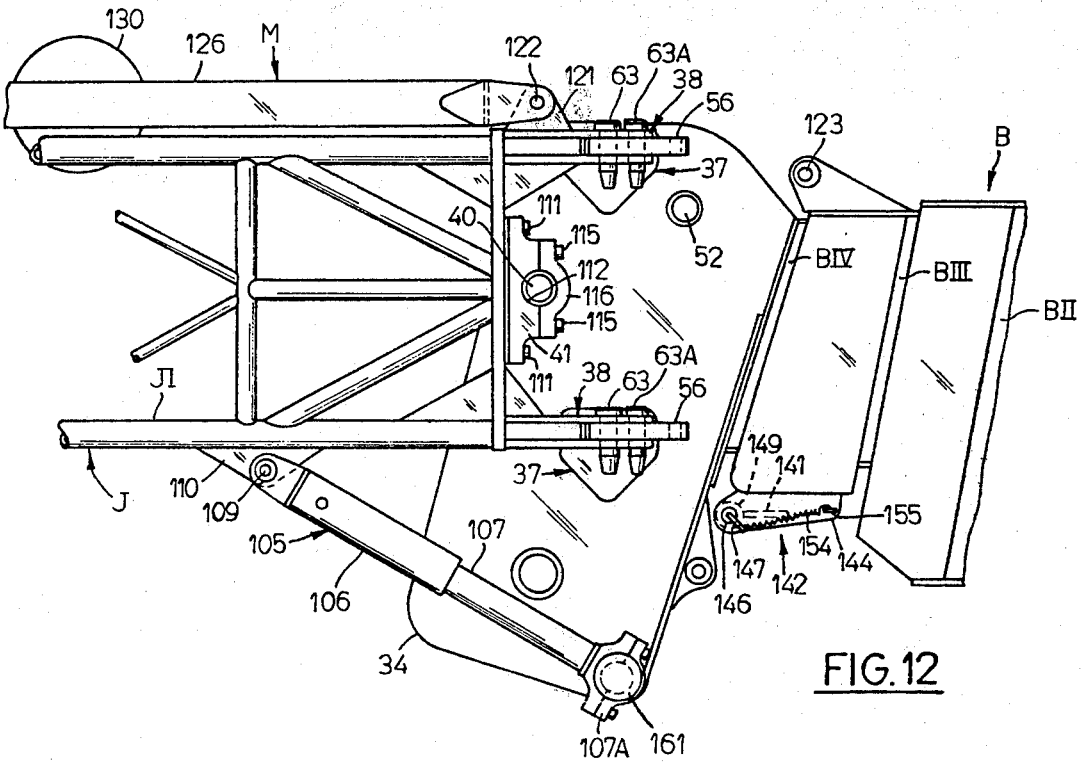
FIG. 12 is a side elevational view of the point end of the boom and the base end of the jib taken on line 12—12 of FIG. 10.

As FIGS. 12 and 13 best show, means are provided to prevent the jib J from assuming an excessively tilted position with respect to the boom B. During erection such means comprise a pair of laterally spaced apart struts 105, each of which is pivotally connected to and removably detachable from a pin 161 on the working head 34 of the boom B and a pin 109 near the base end of the jib section JI. In FIGS. 12 and 13 a strut 105 is shown in its nearly extended position. It is to be understood, however, that each strut can be telescoped to the position shown in FIG. 8 in phantom to limit the tilt angle of the jib J either downwardly or upwardly. Backward tilt of the jib is limited to 5° backward tilt by federal regulations. Each strut 105 comprises a hollow sleeve portion 106 which is pivotally connected at one end, as by pin 109, to a bracket 110 rigidly secured to jib J. Each strut 105 further comprises a rod 107 which is adapted to move within sleeve 106 between two extreme positions. Rod 107 is pivotally connected at one end, as by pin 161 and a cap 107A, so as to be secured to working head 34 of the boom B.

The Mast

Figure 7:
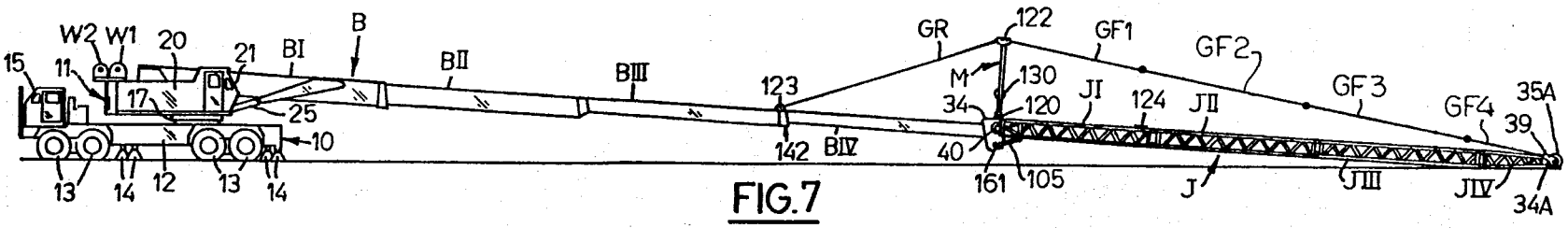
FIG. 7 is a view similar to FIG. 6 and showing the main boom fully extended and four jib sections connected together to form the jib.

The improved self-storing and self-erecting jib mast M is provided on jib J for supporting the jib during rigging and operation of the crane. The jib mast M is pivotally mounted on the upper side of the jib J and cooperates with the guy lines GR and GF to support the jib during set-up and operation of the crane. The jib mast M has its lower end pivotally connected by pins 120 to brackets 121 located on the top side of the base end of the jib J so that it can assume a stored position wherein it lies on the jib (see FIGS. 1 and 3) and from which it can automatically be raised into supporting position, as shown in FIG. 4 and elsewhere. In practice, the rear and front guy lines GR and GF, respectively, are connected between a bracket 122 at the upper end of the mast M and to brackets 123 on boom section BIII and an erection link 124 on the jib J, respectively, while the mast is in lowered or stored position. The rear guy line GR is anchored to bracket 123 on the intermediate boom section BIII so that, upon extension of the fly section BIV of the boom B, the mast M is automatically raised and the guy lines GR and GF are tightened thereby supporting the jib either for working purposes or while additional jib sections are connected. If more than one jib section such as JI is to be employed, the front guy line GF which is normally connected between the mast M and the end of the jib base section JI is replaced by a longer front guy line (as FIG. 7 shows) which is connected between the mast M and the point end of the jib point section JIV after the additional jib sections JII and JIII have been connected. As FIG. 14 shows, jib mast M comprises a pair of laterally spaced apart rigid side members 126 which are interconnected by a plurality of lateral support braces 127. The uppermost end of each side member 126 is provided with a bracket 122 which is rigidly secured, as by welding, to the side member and is provided with a pair of holes 128 (shown in FIGS. 1 and 4) for facilitating the attachment of the guy wires. A sheave 130 is provided on the mast M to accommodate the load line AH, as FIG. 8 shows, and prevent it from being snagged if the jib J is tilted from the axially aligned position shown in FIG. 8 to a tilted position indicated by the phantom lines in FIG. 8. The sheave 130 is rotatably supported on a pin 131 which, in turn, is mounted on a pair of brackets 132 which are rigidly secured between a pair of adjacent cross braces 127, as FIG. 14 best shows. FIG. 14 also shows that the lower ends of the side members 126 of the mast M are pivotally connected by means of pins 120 to brackets 121 which are rigidly secured in spaced apart relationship at the base end of jib section JI.

Safety Locking Means

As FIGS. 15, 16 and 17 best show, the improved releasable safety locking means for preventing the extended boom fly section BIV from accidentally telescoping inwardly into its adjacent intermediate boom section BIII under the weight of the jib J in the event of a hydraulic system failure or inadvertent operation of the retract telescope means by the operator (which allows the fly cylinder to retract) take the form of a jam plate 140 ridiidly mounted at or near the base end of the extended boom fly section BIV, which plate 140 is engageable in interfering relationship with a selectively movable spring-biased locking member 141 of a locking assembly 142 mounted at or near the outer end of the adjacent intermeidate boom section BIII.

The jam plate 140 is on the underside of the base end of the boom fly section BIV to prevent the fly section from accidentally telescoping back into the intermediate section BIII after the fly section BIV has been extended to the position shown in FIG. 8 in the event that a holding valve (not shown) in the hydraulic operating circuit for holding the fly section BIV extended fails or the retract telescopic lever is accidentally engaged for the fly section. The jam plate 140 is adapted to cooperate with the locking assembly 142 which is provided on the underside of the intermediate boom section BIII near the forward end thereof. The locking assembly comprises a base plate 143 which is secured, as by welding, to intermediate boom section BIII and a pair of laterally spaced apart downwardly depending side plates 144 which are rigidly secured, as by welding, to the base plate 143. Each side plate 144 is provided with a pin hole 145 for rotatably accommodating the end of a pin 146 therethrough. One end of the pin 146 is provided with a pin lever 147 which is rigidly secured thereto, as by welding, and the other end of the pin 146 is provided with a cotter key 148 in a hole therethrough. The locking member 141 is rigidly secured to and extends radially outwardly and rotatable with a sleeve 149 which is mounted on the pin. The hollow cylindrical sleeve 149 is disposed on pin 146 between the side plates 144 and is connected thereto for movement therewith by a pin 150. The radially extending member 141 is rigidly secured to the sleeve 149 as by welding at 152. In FIGS. 15, 16 and 17 the boom fly section BIV is shown as fully extended from the intermediate boom section BIII, and the locking member 141 is shown in locking position wherein it is disposed in the path of the jam plate 140 and would prevent retraction of the fly section. The locking member 141 is maintained in locking position by means of the coiled tensioning spring 154 which has one end connected to a bracket 155 rigidly secured to a side plate 144 and has its opposite end connected to a pin 157 extending outwardly of the lever 147. The biasing spring 154 holds the locking member 141 in the locking position shown in solid lines in FIG. 16 during operation of the crane. However, when it is desired to release the locking member to permit retraction of boom fly section BIV, the locking member 141 is rotated manually in a clockwise direction to its alternate position, as shown in phantom lines in FIG. 16, out of the path of the jam plate 140. As the locking member 141 is rotated, the biasing spring 154 is caused to extend slightly and moves overcenter into an alternate position wherein it subsequently biases the locking member 141 against a lateral brace plate 160.

Operation

The crane operates in the following manner, assuming that all components are in the condition shown in FIGS. 1 and 2, the boom B is fully retracted, and the jib J is swung into stored position on the boom support assemblies 36 and locked thereon. Further assume that the hinges are in the condition shown in FIG. 11 wherein the hinge elements 38 on jib J and the hinge elements 40 on boom B are disconnected and the link 56 is secured in open position by means of pin 63A.

To set up the jib J for operation it is preferable to swing the crane upper 11 from the position shown in FIG. 1 to the reversed position shown in FIG. 3 and to extend the outriggers 14. The locking clamp bolts 95 shown in FIG. 18 are then removed and the outermost clamp 78 is swung down to its open position. The hinge links 56 are then moved from the position shown in phantom in FIG. 9 and attached to the jib J as shown in FIG. 9, whereupon jib J is swung horizontally manually to the position shown in FIG. 10 into alignment with boom B. It is to be understood that prior to swinging of jib J to the position shown in FIG. 10 the journal caps 116 must be removed from the journals 41 so that the latter can make proper engagement with the ends of the horizontal pin 40. Thereafter, with the jib J in the position shown in FIG. 10, the caps 116 are secured to the journals 41.

Before an attempt is made to swing jib J horizontally from the jib support assemblies 36 it is necessary to remove the locking pins 89 of the jib support assemblies so that the members 77 can tilt downwardly as the jib slides outwardly thereacross. The downwardly tlting action of the members 77 reduces frictional forces between the jib J and the upper surfaces of the members 77 and facilitates removal of the jib from the jib storage assemblies 36. When the jib J is clear of the jib support assemblies 36, each assembly may be placed and locked in the stored position shown in FIG. 20. If the jib is to be employed in axial alignment with boom B, the links 56 must be swung to the rearward position and the furnished guy lines, properly connected, will provide the aforementioned alignment.

At this point jib J is in the position shown in FIG. 3 and mast M is still in stored position. It will be noted, however, that the guy lines GR and GF are attached as hereinbefore described. To erect the mast and render the guy lines taut, boom fly section BIV is extended from the position shown in FIG. 3 to the position shown in FIG. 4, whereupon rear guy lines GR become taut and raise mast M and forward guy lines GF become taut to effectively support jib J. It will be noted from FIG. 4 that, with boom fly section BIV fully extended, the locking means 142 are brought into play and prevent inadvertent or accidental retraction of boom fly section BIV which would cause the guy lines to slacken.

Figure 11:
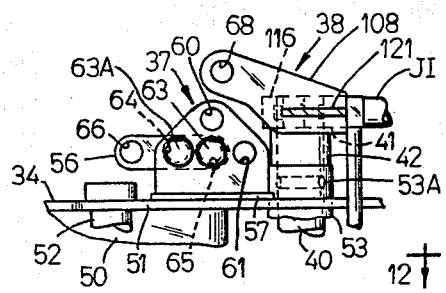
FIG. 11 is a detailed view of a portion of the hinge means shown in FIG. 9 and showing the hinge means in an alternate position.

When jib J has assumed the position shown in FIG. 3, the struts 105 are installed as shown in FIGS. 12 and 13. Once the jib J is secured with the journal caps 116 secured to pin 40 as shown in FIG. 4 and the struts 105 are in place, then the jib guy line GF is disconnected from the erection link 124 by retracting boom section BIV to slacken the guy lines or cables and an additonal jib JIV guy line is connected to guy line GF and fan item 39, made reasonably taut, and the links 56 swung to the jib operating position as shown in FIG. 11. The crane may be used in the conventional manner by rigging the hoist lines as described and by extending the various boom sections to the desired length for the basic 30 foot jib length.

Figure 5:
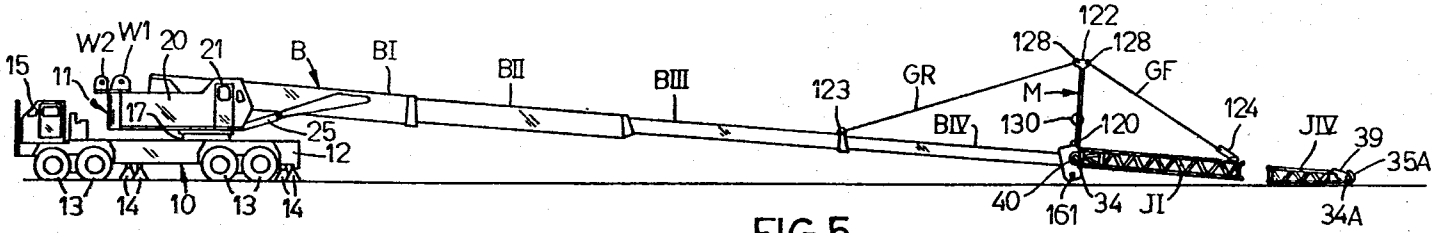
FIG. 5 is a view similar to FIG. 4 but showing the main boom fully extended toward the ground and showing the jib point section detached.
Figure 6:
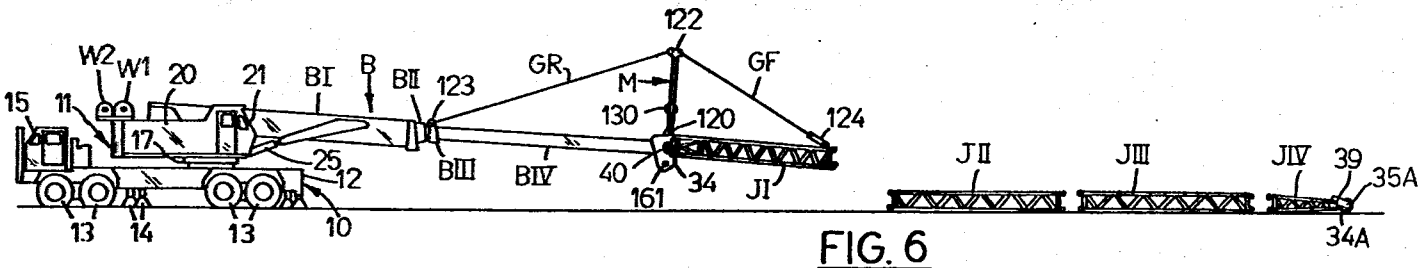
FIG. 6 is a view similar to FIG. 5 but showing the main boom partially retracted and several jib sections disposed on the ground.

FIGS. 5, 6 and 7 show the manner in which the jib J may be extended by the addition of other intermediate jib sections thereto. As FIG. 5 shows, boom B is extended to its full length in a slightly downward direction so that the jib point section JIV rests on the ground and can be detached from jib base section JI. Boom B is then retracted, as shown in FIG. 6, to provide space for insertion, for example, of additional jib sections JII and JIII between the jib sections JI and JIV. When the sections JI, JII, JIII and JIV have been interconnected, the relatively short forward guy line GF is relaced by additional guy lines GF1, GF2, GF3, GF4 as shown in FIG. 7. GF4 is then connected to fan 39 in a hole stamped to indicate jib length. FIGS. 7 and 8 show jib J in an arrangement where it is in axial alignment with boom B. However, jib J can also be employed in a downwardly tilted arrangement as shown in phantom lines in FIG. 8. To accomplish tilting of jib J it is necessary that the point of the jib J be rested on the ground as shown in FIG. 7. It is also necessary to then retract fly BIV, after the latch is released, so that the guy line GR will slacken to allow insertion of suitable links between GR and 123 or to use a relatively longer guy line in order for the multisection jib J, shown in FIGS. 7 and 8, to assume the tilted position indicated in FIG. 8. The connector 39 permits forward guy lines to be attached to the point end of jib J for purposes of adding extra jib sections with guy lines of corresponding equal length to be added.

Jib J is disassembled and stored by reversing the procedural steps indicated above. More specifically, if a multisection jib J has been used the procedures shown in FIGS. 5, 6 and 7 are reversed. If a jib J comprising merely a base section JI and a point section JIV is employed, as shown in FIGS. 1, 3 and 4, then the procedural steps shown in those figures are reversed. Before boom fly section BIV can be retracted into intermediate boom section BIII it is necessary that the locking member 141 of the locking means 142 be swung from the locking position shown in solid lines in FIG. 16 clockwise to the unlocked position shown in phantom lines in FIG. 16. When this is done it is possible for jam plate 140 to move past the position formerly occupied by locking member 141. When jib J is ready to be swung from the position shown in FIG. 3 to the stored position shown in FIG. 1, it is necessary beforehand to swing the jib support assemblies 36 into proper position and to lock them in place by the locking pins 97 and to remove the locking pins 89 so that the members 77 thereof can assume their downwardly tilted position, shown in FIG. 18. This allows jib J to slide into engagement with the members 77 while gradually moving them into their horizontal jib storage position and into a position where the locking pins 89 can again be inserted. When jib J is finally in place the outermost locking clamp 78 may be swung into the position shown in solid lines in FIG. 18, and the locking bolts 95 may be inserted to fully engage the clamps 78 around the longitudinal members of jib base section JI.

We claim:

1. In a mobile crane: a boom swingable upwardly and downwardly in a vertical plane; a jib having a base and selectively and pivotably connectable to the point end of said boom, said jib being swingable in a horizontal plane to and from a jib storage position alonside said boom; jib storage means on said crane to facilitate storage of said jib in a generally horizontal plane alongside said boom, said jib storage means comprising at least one jib storage assembly disposed adjacent said boom, said jib storage assembly comprising: a first support member, means pivotally mounting said first support member for pivotal movement in a direction outwardly of said boom; and a second jib support member pivotally connected to said first support member and pivotable about a horizontal axis which is generally parallel to said vertical plane by said jib between a horizontal jib storage position wherein the jib can rest thereon and a downwardly tilted jib loading and unloading position such that as said jib is slid horizontally off of or onto said second jib support member the latter is pivoted in response to the sliding movement of the jib.

2. A crane according to claim 1 including means for releasably locking said second jib support member in said horizontal storage position when said jib is disposed thereon.

3. A crane according to claim 1 including mounting means for said first support member whereby said first support member is movable horizontally between a position wherein it extends laterally in said direction outwardly of said boom and a storage position alongside said boom.

4. A crane according to claim 3 including means for locking said first support member in either the position wherein it extends outwardly of said boom or said storage position alongside said boom.

5. A crane according to claim 2 including means for releasably securing said jib on said first support member when said jib is disposed thereon.

6. In a mobile crane: a boom swingable upwardly and downwardly in a vertical plane; a jib having a base end selectively and pivotably connectable to the point end of said boom, said jib being swingable in a horizontal plane to and from a jib storage position alongside said boom; jib storage means on said crane to facilitate storage of said jib in a generally horizontal plane alongside said boom, said jib storage means comprising at least one jib storage assembly disposed adjacent said boom, said jib storage assembly comprising: a first support member extendable laterally in a direction outwardly of said boom; mounting means for pivotally connecting said first support member to a side of said boom and whereby said first support member is swingable horizontally between a position wherein it extends laterally in siad direction outwardly of said boom and a storage position alongside said boom; means for locking said first support member in either the position wherein it extends outwardly of said boom or said storage position alongside said boom; a second jib support member pivotally connected to said first support member and pivotable about a horizontal axis which is generally parallel to the longitudinal axis of said boom by said jib between a horizontal jib storage position wherein the jib can rest thereon and a downwardly tilted jib loading and unloading position; means for releasably locking said second jib support member in said horizontal storage position when said jib is disposed thereon; and means on said second jib support member for releasably securing said jib on said first support member when said jib is disposed thereon, said last recited means including a member pivotably connected near the outer end of said second jib support member and swingable clear of the path of movement of said jib.

7. A mobile crane according to claim 6 wherein said jib storage means comprises a pair of jib storage assemblies disposed in longitudinally spaced apart relationship alongside said boom.

8. A mobile crane according to claim 7 wherein said assemblies are connected to the base section of said boom.

* * * * *